United States Patent [19]

Boom et al.

[11] Patent Number: 4,538,735

[45] Date of Patent: Sep. 3, 1985

[54] APPARATUS FOR SEPARATING SOLIDS OF DIFFERENT SHAPES

[75] Inventors: Johannes Boom; Teunis Terlouw, both of Amsterdam, Netherlands; Pieter Visser, deceased, late of Oegstgeest, Netherlands, by Antonia Jacoba Visser, née Van der Heide, legal representative

[73] Assignee: Shell Oil Company, Houston, Tex.

[21] Appl. No.: 417,930

[22] Filed: Sep. 14, 1982

[30] Foreign Application Priority Data

Sep. 23, 1981 [GB] United Kingdom ..... 8128776

[51] Int. Cl.[3] ..... B07C 5/34

[52] U.S. Cl. ..... 209/691; 209/940; 209/707; 193/17

[58] Field of Search ..... 209/691, 692, 695, DIG. 940, 209/694, 700, 707, 908, 910, 922, 254; 193/17

[56] References Cited

U.S. PATENT DOCUMENTS

| | | | |
|---|---|---|---|
| 871,536 | 11/1907 | Thompson | 209/691 |
| 897,489 | 9/1908 | Prinz | 209/691 |
| 2,068,146 | 1/1937 | Medcalf | 209/691 |
| 2,675,947 | 4/1954 | Wynn, Sr. | 193/17 |
| 3,009,571 | 11/1961 | Roberts, Jr. | 209/908 X |
| 3,672,500 | 6/1972 | Hayes | 209/116 |
| 4,059,189 | 11/1977 | John | 209/692 X |
| 4,068,758 | 1/1978 | Abdul-Rahman | 209/691 |
| 4,068,759 | 1/1978 | Abdul-Rahman | 209/691 |

FOREIGN PATENT DOCUMENTS

| | | | |
|---|---|---|---|
| 1224614 | 3/1971 | United Kingdom . | |
| 698682 | 11/1979 | U.S.S.R. | 209/694 |

*Primary Examiner*—David A. Scherbel
*Assistant Examiner*—Glenn Foster

[57] ABSTRACT

Apparatus for separating spherically-shaped solids from irregularly-shaped solids comprising a rotatable separating table having a frustoconically shaped upper surface, the angle of inclination of the upper surface with the horizontal being such that spherically-shaped solids supplied onto the upper surface will roll down towards a central vertical conduit at the lower end of the upper surface and irregularly-shaped solids supplied onto the upper surface remain at rest. The apparatus further includes a number of supply structures for the supplying of a mixture of spherically-shaped solids and irregularly-shaped solids onto the upper surface and removal means for removing irregularly-shaped solids from the upper surface.

7 Claims, 4 Drawing Figures

APPARATUS FOR SEPARATING SOLIDS OF DIFFERENT SHAPES

BACKGROUND OF THE INVENTION

The present invention relates to an apparatus for separating solids of different shapes and in particular is directed to an apparatus for separating spherically-shaped solids from irregularly-shaped solids.

When producing spherically-shaped solids it may happen that in addition to the desired spherically-shaped solids irregularly-shaped solids are formed. Furthermore, impacts on the produced spherically-shaped solids, occurring during handling and transport, may cause damage of part of the formed spherically-shaped solids. If a spherical shape of the solids is essential for processing and/or use of the solids, it is important to separate the required spherically-shaped solids with a high efficiency from the irregularly-shaped solids.

In this context, reference can be made to the use of solids as catalyst in the oil industry for the catalytic treatment of hydrocarbons, such as for the catalytic desulphurization and demetallization of petroleum residues. The catalytic treatment of hydrocarbons can be carried out in fixed bed reactors or moving bed reactors. Reactors of these types are internally so constructed that one or more beds of catalyst material can be formed with fluid to be treated passing through these beds. At the lower part of the beds normally screens are arranged being impermeable to the catalyst material. Especially when using large-size reactors, which are operated at high pressures, the catalyst material in the catalyst beds should be able to withstand high compression forces. In view of their high crushing strength, the use of spherically-shaped solids as catalyst in reactor bed operations is preferred. Irregularly-shaped solids of a particular material have a crushing strength which is smaller than the crushing strength of spherically-shaped solids of the same material. A further critical point in catalyst bed reactor operations is the efficiency of the screens for separating treated fluid from the catalyst beds. Pinning of the catalyst particles against the screens, therby plugging the screens, should be prevented as much as possible for enabling an undisturbed separation of the reactor effluent through the screens. Since with spherically-shaped catalyst particles the risk of pinning against screens is much less than when using irregularly-shaped catalyst particles, the reactor bed should preferably contain substantially only spherically-shaped catalyst particles.

When the catalyst material in a catalyst bed reactor has been deactivated to a certain extent the reactor is unloaded and filled with fresh catalyst material. The deactivated material is in the meantime treated to remove the contaminations absorbed or adhered during the fluid treatment in the reactors, so that the material may be re-used as catalyst. During the use in the reactor and the cleaning afterwards of the catalyst material the forces exerted on the catalyst material may result in crushing of part of the material, so that a part of the material will become irregularly-shaped. For the reason explained in the above, this crushed part of the catalyst should be removed prior to re-using the material in reactors.

From the above it will be clear that catalyst used in reactors should preferably be spherically-shaped and irregularly-shaped particles should be removed as much as possible from the bulk of desired spherically-shaped particles.

Apart from the above-mentioned example wherein the use of spherically-shaped particles is essential, there are a large variety of other operations wherein a spherical shape of the applied particles is of great importance.

A further example is amongst others the production of porous products built up from separate particles. To obtain a sufficient porosity of the product the base particles should preferably have a uniform spherical shape.

The ever increasing demand for larger quantities of products, prepared by means of particles of spherical shape, requires separating apparatus for separating spherically-shaped particles from irregularly-shaped particles having a high efficiency and allowing high throughputs.

SUMMARY OF THE INVENTION

The object of the invention is to provide such a separating apparatus having a high efficiency and allowing high throughputs.

The apparatus for separating spherically-shaped solids from irregularly-shaped solids thereto comprises a substantially horizontally arranged separating table having a downwardly converging substantially frustoconical upper surface, the angle of inclination of the upper surface with the horizontal being at least as great as the roll angle of spherically-shaped solids and less than the slide angle of irregularly-shaped solids, the lower end of the upper surface being connected to a vertical conduit for receiving spherically-shaped solids rolled from the upper surface. A means is provided for supplying a mixture of spherically-shaped solids and irregularly-shaped solids onto the upper surface of the separating table with the supply means being rotatably arranged relative to the separating table with the axis of rotation substantially coinciding with the vertical axis of the separating table. A means is provided for removing irregularly-shaped solids from the upper surface, the removal means when viewed in the direction of relative rotation between the separating table and the supply means being arranged at some distance from the supply means.

The supply means may be formed by a single supply structure or may consist of a plurality of supply structures spaced apart from each other when viewed in the direction of the relative rotation between the separating table and the supply means. When using a plurality of supply structures, the apparatus according to the invention also uses a plurality of devices for removing irregularly-shaped solids from the upper surface. The plurality of removal devices should be spaced apart from each other in such a manner that between each pair of supply structures a device for removing irregularly-shaped solids from the upper surface is arranged.

BRIEF DESCRIPTION OF THE DRAWINGS

According to a suitable embodiment of the invention, the separating table is rotatably arranged about its vertical axis.

The invention will now be discussed in more detail by way of example with reference to the accompanying drawings wherein.

DESCRIPTION OF THE PREFERRED EMBODIMENT

Figure 1:
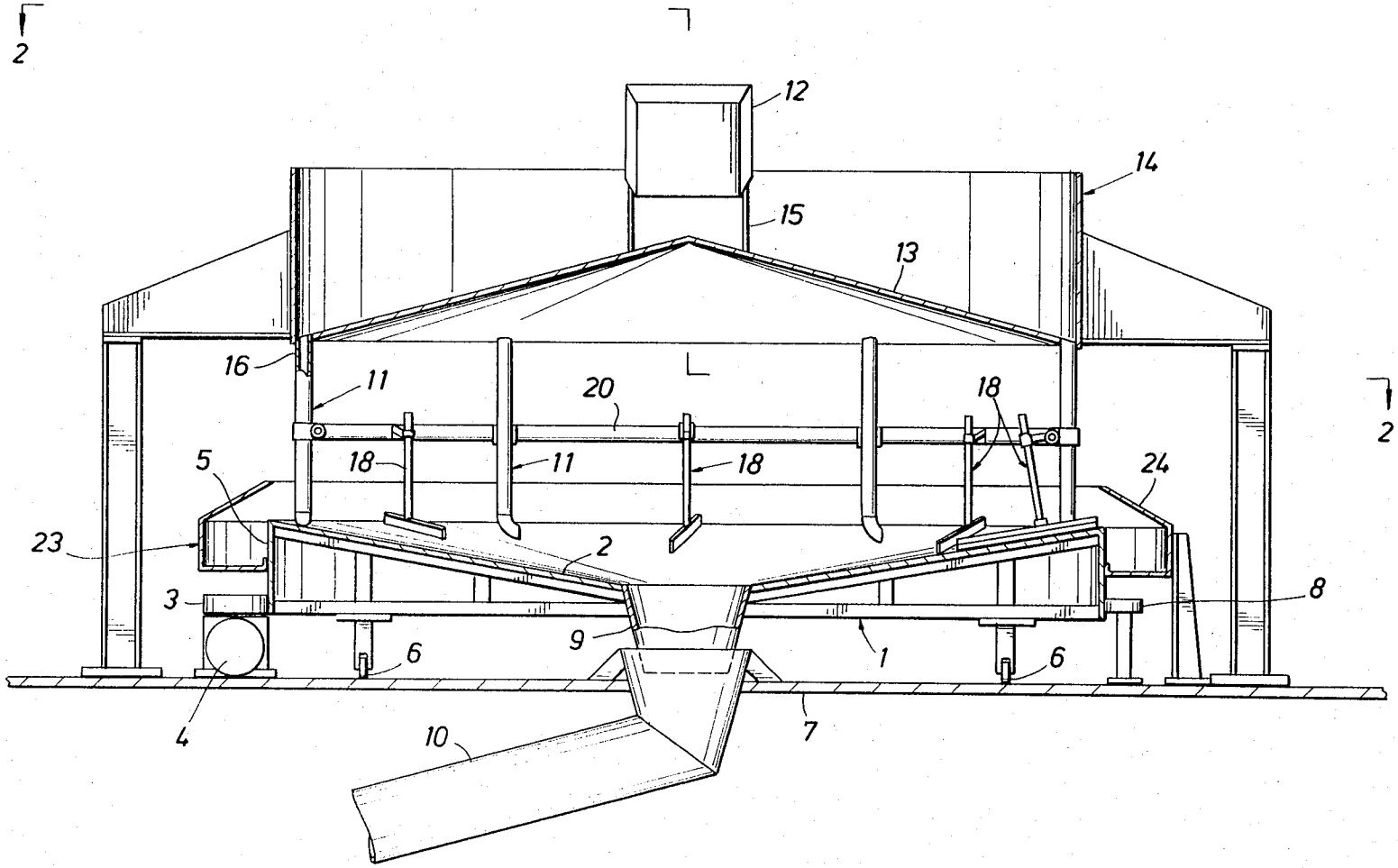
FIG. 1 shows a vertical cross section of a separating apparatus according to the invention.
Figure 2:
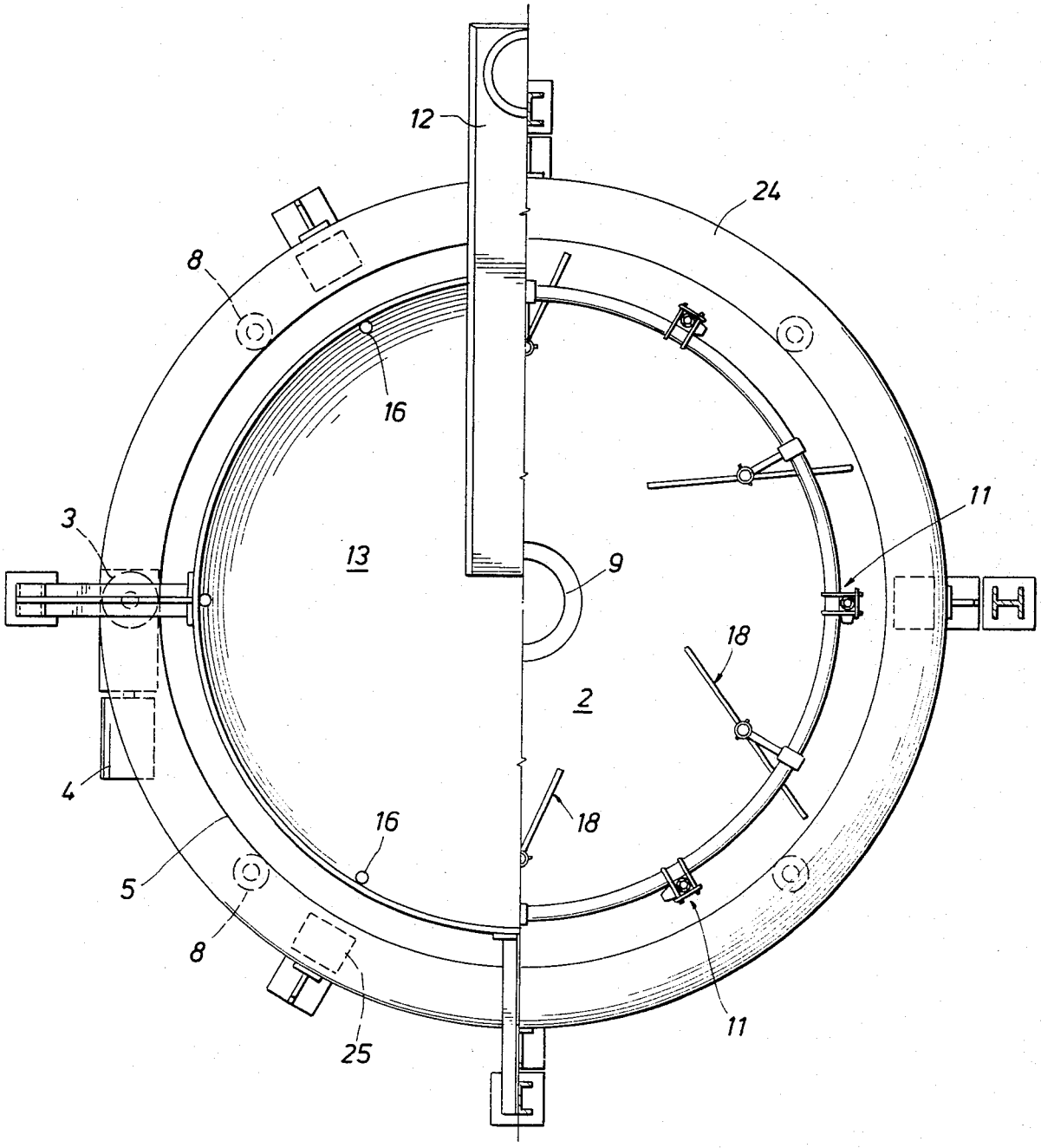
FIG. 2 shows a top view with horizontal cross section A—A of the separating apparatus shown in FIG. 1.

The apparatus for separating spherically-shaped solids from irregularly-shaped solids as shown in FIGS. 1 and 2 comprises a horizontally arranged, rotatable separating table 1 having a downwardly converging, substantially frustoconical upper surface 2. For rotating the separating table 1 a driving wheel 3 driven by a motor 4 is in contact with the vertical side 5 of the separating table 1. The separating table 1 is supported by means of a plurality of supporting wheels 6 allowing rotation of the separating tale 1 with respect to a support plate or base 7. Around the periphery of the separating table 1, a plurality of guide wheels 8 are arranged for guiding the separating table 1. For centering purposes some of said guide wheels 8 may be adjustable with respect to the vertical axis of the separating table 1.

The upper surface 2 of the separating table 1 forms the most essential element in the separating apparatus for causing a separation between spherically-shaped solids and irregularly-shaped solids. For enabling this separation the angle of inclination of the upper surface 2 with the horizontal is so chosen that spherically-shaped solids laid down on the upper surface 2 will roll down the surface whereas irregularly-shaped solids will remain on the upper surface 2. In this manner the two types of solids supplied onto the upper surface 2 may be separately collected. The angle of inclination of the upper surface 2 should be at least as great as the roll angle of the spherically-shaped solids, supplied onto the upper surface 2 and should be less than the slide angle of irregularly-shaped solids supplied onto the upper surface 2. The angle of inclination of the upper surface 2 depends on the smoothness on the upper surface 2 and the type of material of the solids.

The roll angle of the spherically-shaped solids is determined by laying a rolling solid at rest on an inclined surface having the same smoothness as the upper surface 2 and releasing such rolling solid. By varying the rate of inclination of the surface the minimum angle at which the released solid will roll down the required minimum inclination of the upper surface can be determined. The slide angle of irregularly-shaped solids is determined by holding a non-rolling solid at rest on the inclined surface and releasing the irregularly-shaped solid. By varying the rate of inclination the minimum angle of inclination of the surface at which such released solid will slide down along said surface can be ascertained.

As shown in FIG. 1, the lower end of the upper surface 2 is connected to a vertical conduit 9 for receiving spherically-shaped solids rolled down the upper surface 2. A tube 10 passing through an opening in the support plate 7 and having the upper part enclosing the lower end of the vertical conduit 9 forms a passage between the vertical conduit 9 and further transporting means (not shown) such as a belt convenyor for transporting the separated spherically-shaped solids to collecting means (not shown) arranged at a suitable distance from the separating table 1.

The separating apparatus shown in FIGS. 1 and 2 further comprises a plurality of supply tubes or structures 11 for supplying material onto an upper part of the upper surface 2. The supply structures 11 are substantially equally divided or spaced over the upper part of the upper surface 2.

Material to be separated is transported from a bunker (not shown) via an inclined gutter or channel 12 to the bottom 13 of a box-like structure 14, said gutter or channel 12 being supported by a support element 15 extending between said gutter or channel 12 and said bottom 13. The bottom 13 of the box-like structure 14 is conically shaped having an apex pointing upwardly, the upper parts of the supply structures 11 being arranged in openings in the lower part of said bottom 13 to allow the passage of material from the gutter 12 to each of said supply structures 11.

Figure 3:
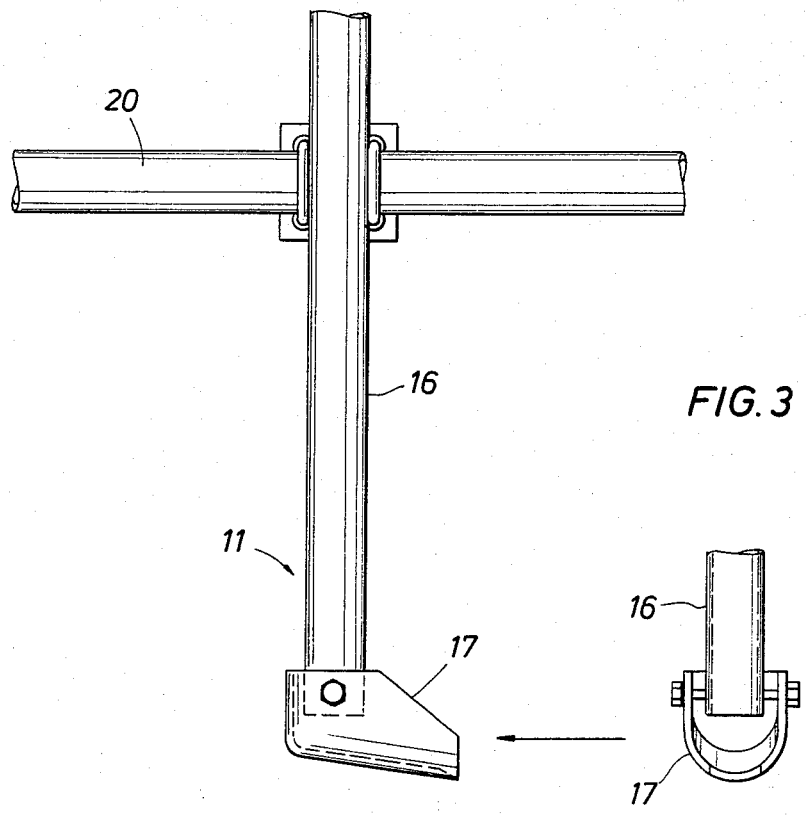
FIG. 3 shows the supply means shown in FIG. 1 on a larger scale.

As shown in FIG. 3 the supply structures 11 each comprise an open-ended conduit 16 substantially perpendicular to the upper surface 2 and a trough-like dispersing device 17 having a U-shaped free end and being pivotably connected to the lower part of the relevant conduit 16. The free ends of the dispersing devices 17 are positioned substantially tangentially with respect to the direction of rotation of the separating table 1. The width of the U-shaped free end of each trough-like dispersing device 17 and the inclination of the trough-like device are suitably so chosen that a line of particles having substantially no horizontal velocity can be supplied onto the upper surface 2. The angle of inclination of the dispersing devices should be at least greater than the static sliding angle for irregularly-shaped solids. The lower end of each dispersing device 17 is positioned at a small distance above the upper surface 2, so that during operation particles from the dispersing devices 17 will fall on the surface 2 with a small vertical velocity. The spherically-shaped solids will thereby jump over the irregularly-shaped solids, so that an immediate separation between said two types of particles is obtained, and spherically-shaped solids are not hampered in their movement by the irregularly-shaped solids lying at rest on the upper surface 2.

Figure 4:
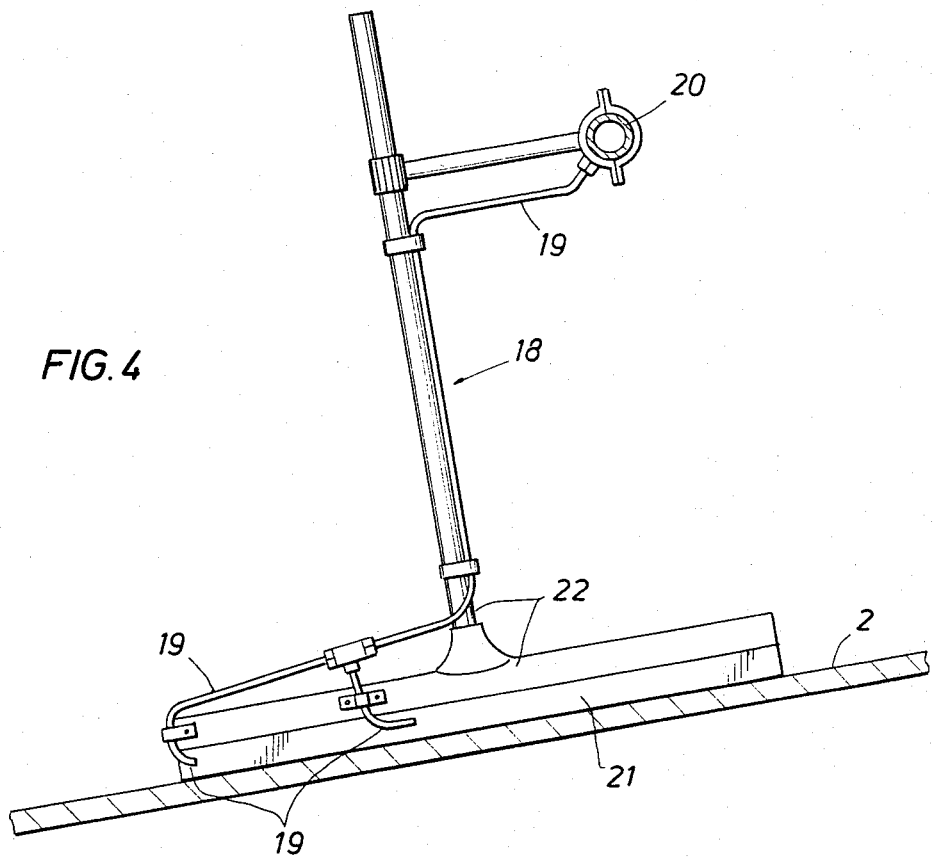
FIG. 4 shows the removal means shown in FIG. 1 on a larger scale.

For removing irregularly-shaped solids which remain substantially at rest when supplied onto the upper surface 2, removal means 18 are arranged between each pair of adjacent supply structures 11. As more clearly shown in FIG. 4 each removal means 18 comprises a tube arrangement 19 provided with one or more nozzles (not shown) for the supply of fluid jets along the upper surface 2 in a direction towards the upper end of the upper surface 2. The tube arrangements 19 are so positioned relative to the upper surface 2 that the emitted air jets will blow the irregularly-shaped particles from the upper surface 2 via the upper end thereof.

The tube arrangements 19 are in fluid communication with the interior of a ring-shaped pipeline 20, which in its turn can be connected to a pressurized air system. It is noted that the ring-shaped pipeline 20 also supports the supply structures 11.

TO avoid interference between the air jets emitted from a tube arrangement 19, and the supply of material via an adjacent supply structure 11, elongated elements 21 are arranged between the tube arrangements 19 and the supply structures 11. The elongated elements 21 are each attached to a structure 22, which is hingeably mounted on the ring-shaped pipeline 20, thereby allowing the elements 21 to follow the upper surface 2 during rotation of the separating table 1. The elongated elements 21 are preferably positioned at an angle with respect to the direction of rotation of the separating table 1, so that during rotation of the upper surface 2 material collected in front of elements 21 is pushed toward the outer ends of said elements positioned at the outer edge of the upper surface 2.

The shown separating apparatus further comprises a ring-shaped gutter 23 arranged around the outer periphery of the upper surface 2, for collecting material dropped from the upper edge of the upper surface 2. The gutter 23 is provided with an inclined guide plate 24 to prevent particles falling from the upper surface 2 to jump over the gutter 23. For removing material from the gutter 23 a number of openings 25 are arranged in the bottom of the gutter 23.

The operation of the apparatus shown in FIGS. 1 and 2 is as follows.

A mixture of spherically-shaped solids and irregularly-shaped solids is fed via gutter 12, the inclined bottom 13 of the box-like structure 14 and the conduits 16 with dispersing devices 17 of the supply structure 11 onto the upper part of the inclined upper surface 2. The separating table 1 is caused to rotate in a clockwise direction by the action of the driving wheel 3, driven by the motor 4. The distance between the bottom of each dispersing device 17 and the lower end of the accompanying conduit 16, and the angle of inclination of each dispering device 17 are so chosen that all supplied particles will slide or roll over the bottom of the dispersing device 17, so that a line of material will be supplied onto the upper surface 2, during rotation of the separating table 1.

Since rolling spherically-shaped solids will pass the dispersing devices substantially faster than sliding irregularly-shaped solids, the dispersing devices 17 ensure a self-controlled supply of material onto the upper surface 2.

When the spherically-shaped solids and irregularly-shaped solids hit the upper surface 2, the larger part of the spherically-shaped solids will roll from the inclined surface 2 into the vertical conduit 9. Via the tube 10, these solids are transported to a receiving means (not shown). Most of the irregularly-shaped solids which are fed onto the inclined upper surface 2 remain at rest on said surface. Due to the rotation of the upper surface 2 the solids remaining substantially at rest on the surface 2 move in a generally circular path away from the supply structures 11, so that the material fed onto the upper surface 2 continuously meets a clean part of the upper surface 2. During the rotation of the upper surface 2 spherically-shaped solids trapped by the irregularly-shaped solids will partly roll free from the irregularly-shaped solids and enter into the vertical conduit 9. The air jets supplied through the tube arrangements 19 cause the irregularly-shaped solids to move via the upper edge of the upper surface 2 into the collecting gutter 23. The elongated elements 21 form barriers for the irregularly-shaped solids on the upper surface 2, so that the supply of material via a supply structure is not hindered by material supplied via an adjacent supply structure. The collected irregularly-shaped solids are subsequently removed from said gutter 23 via the openings 25. Air jets or scrapers and the like may be applied to urge the irregularly-shaped solids collected in the gutter towards the openings 25.

Although the embodiment of the invention shown in the drawings is provided with a rotatable separating table 1, it is also possible, without departing from the invention, to fixedly mount the separating table 1 and to arrange the supply structures 11 and the removal means 18 in a rotatable manner so that these elements can describe circular paths above the upper surface 2. The numbers of supply structures 11 may be freely chosen. Instead of the six shown in the drawings any other number of supply means and even one supply structure may be applied.

The invention is not restricted to separating apparatus provided with supply means comprising a separate dispersing device 17 as shown in the drawings. Instead thereof the dispersing devices may form integral parts of the conduits 16, formed by bending the lower parts of the conduits 16 and preferably bringing the lower ends into a V-shape.

Instead of the driving arrangement for the rotatable separating table 1 as shown in FIGS. 1 and 2, any other suitable driving arrangement may be applied. The separating table 1 may for example be mounted on a rotatable vertical axis passing through the vertical conduit 9, wherein said vertical axis may be driven by any suitable driving mechanism.

For treating very large amounts of solids to separate spherically-shaped solids from irregularly-shaped solids a plurality of separating apparatuses may be used having the supply structures connected to a single vessel loaded with solids to be treated. A suitable arrangement of a plurality of separating apparatuses is obtained by installing the separating apparatuses above each other, in such a manner that the lowest separating apparatus receives the particles from the vertical conduits for spherically-shaped solids, of the above-arranged separating apparatuses. The lowest separating apparatus serves to remove irregularly-shaped solids left in the bulk of spherically-shaped solids separated in the other separating apparatuses. The separating apparatuses may be suitably mounted on a single rotatable vertical axis passing through the vertical conduits for spherically-shaped solids.

What is claimed is:

1. An apparatus for separating spherically-shaped solids from irregularly-shaped solids comprising:

a substantially horizontal separating table, said separating table having a frustoconical upper surface extending in a downwardly direction towards the center, the angle of said upper surface being at least as great as the roll angle of said spherically-shaped solids and less than the slide angle of the irregularly-shaped solids, said table in addition being mounted for rotation about its vertical axis;

a central vertical conduit, said conduit communicating with a central opening in said separating table for removing the spherically-shaped solids from the apparatus;

a supply means, said supply means being non-rotatively mounted above said separating table and including an open top cylindrical box structure mounted above said separating table, the lower wall of the box structure having a conical shape extending in an upward direction towards the center and having a slope greater than the slide angle of the irregularly-shaped solids and the outer periphery of the box structure being adjacent the outer edge of the separating table;

means for supplying a mixture of spherically- and irregularly-shaped solids to said box structure;

a plurality of supply tubes, said supply tubes being mounted at the periphery of the box structure whereby said solids will flow by gravity from said supply means to the outer portion of said separating table; and removal means for removing the irregularly-shaped solids from the periphery of said separating table, said removable means being spaced intermediate said supply tubes.

2. Apparatus according to claim 1, wherein the supply tubes include a trough-like dispersing device inclined from the horizontal at an angle at least as great as the slide angle of the irregularly-shaped solids.

3. Apparatus according to claim 2, wherein the trough-like dispersing device is pivotably connected to the supply tubes and has a substantially U-shaped free lower end.

4. Apparatus according to claim 2, wherein the trough-like dispersing device is substantially tangentially arranged with respect to the direction of relative rotation.

5. Apparatus according to claim 2, wherein the means for removing irregularly-shaped solids comprises means for the supply of fluid jets onto the upper surface in a direction towards the upper end of the upper surface.

6. Apparatus according to claim 5, wherein the means for removing irregularly-shaped solids further comprises an elongated element disposed adjacent the upper surface of the separating table and cooperating with the fluid jet supply means.

7. Apparatus according to claim 2, wherein the means for removing irregularly-shaped solids comprises an elongated element so arranged relative to the upper surface that during relative rotation beween the separating table and the supply means the elongated element causes irregularly-shaped solids to move up the upper surface and be removed from the upper edge thereof.

* * * * *